US005433339A

United States Patent [19]

Sarver

[11] Patent Number: 5,433,339

[45] Date of Patent: Jul. 18, 1995

[54] CLIP-ON CUP

[76] Inventor: Jonathan W. Sarver, Rte. 3, Box 141, Durham, N.C. 27713

[21] Appl. No.: 333,595

[22] Filed: Nov. 2, 1994

Related U.S. Application Data

[63] Continuation of Ser. No. 106,296, Aug. 13, 1993, abandoned.

[51] Int. Cl.[6] ..... B65D 25/28

[52] U.S. Cl. ..... 220/756; 220/759

[58] Field of Search ..... 224/148, 252, 250, 269; 220/756, 758, 759, 767; 215/100 A; 294/31.2, 27.1

[56] References Cited

U.S. PATENT DOCUMENTS

| | | | |
|---|---|---|---|
| 414,211 | 11/1889 | Grimm | 220/760 |
| 751,009 | 2/1904 | Puterbaugh et al. | 294/31.2 |
| 1,208,728 | 12/1916 | Bartlett et al. | 224/148 |
| 2,501,572 | 3/1950 | Marquez | 220/756 |
| 3,144,230 | 8/1964 | Brooks | 224/148 |
| 4,363,415 | 12/1982 | Rainville | 215/100 A |
| 4,596,337 | 6/1986 | Gerold et al. | 215/100 A |
| 4,727,997 | 3/1988 | Nakamura et al. | 215/100 A |
| 4,802,602 | 2/1989 | Evans et al. | 224/148 |
| 4,804,218 | 2/1989 | Hilliard | 294/31.2 |
| 4,883,290 | 11/1989 | Landa | 224/252 |
| 5,002,193 | 3/1991 | Touzani | 220/759 |
| 5,048,734 | 9/1991 | Long | 224/148 |
| 5,190,196 | 3/1993 | Hamer, III | 224/148 |

*Primary Examiner*—Stephen J. Castellano
*Attorney, Agent, or Firm*—Olive & Olive

[57] ABSTRACT

The present invention according to a first preferred embodiment comprises a cylindrical drinking vessel having a pair of integrally formed circumfrential grooves and a pair of vertically oriented parallel handle support braces on its outer surface. A carabiner, or rope connection latched oval or D-shaped ring, fits between the handle support braces in a position to straddle the pair of circumfrential grooves. A pair of flexible bands are releasably fastened through the carabiner and around the vessel in the circumfrential grooves to secure the carabiner as a handle to the drinking vessel and thus form a cup. In a second preferred embodiment of the invention, the cylindrical vessel is integrally formed with a pair of handle supports to which are assembled a hinged latch so as to emulate the operation of a carabiner. According to a third preferred embodiment, the carabiner is formed separately and fixedly attached to the side of the drinking vessel, for example, by welding.

4 Claims, 3 Drawing Sheets

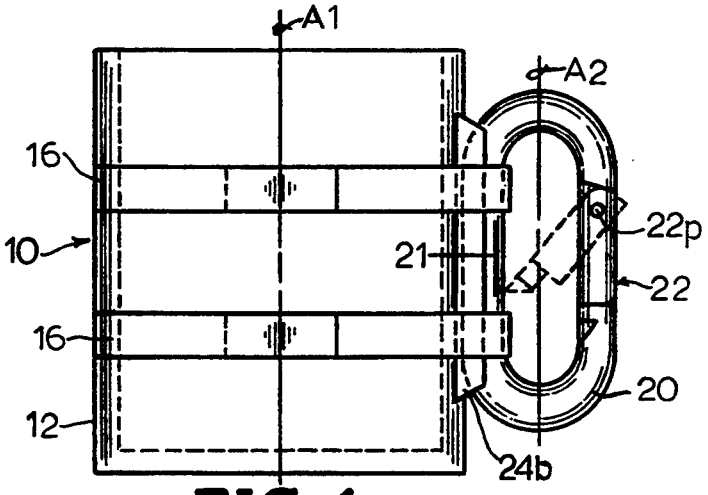
FIG. 1
FIG. 2
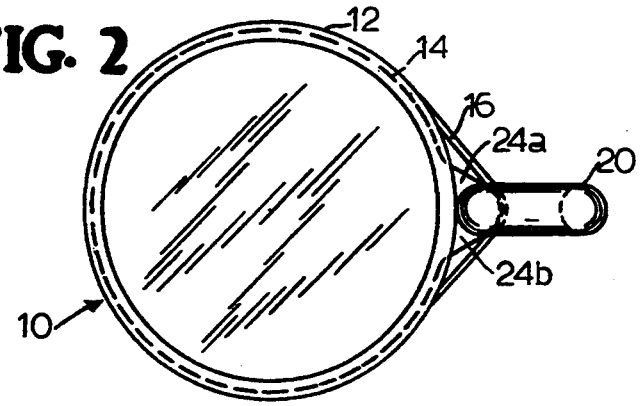
FIG. 3
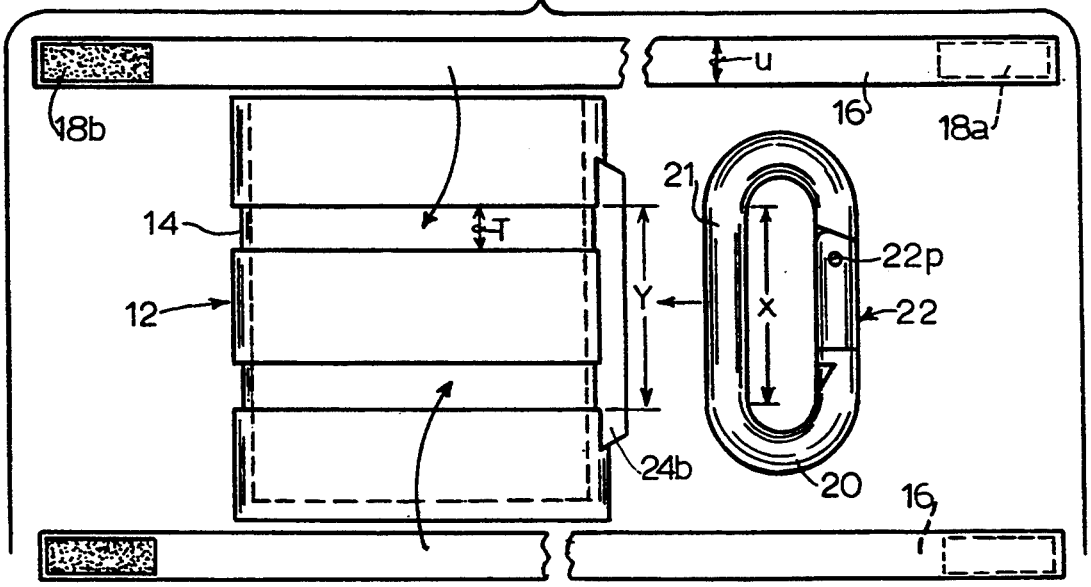

CLIP-ON CUP

This application is a continuation of Ser. No. 08/106,296, filed Aug. 13, 1993, now abandoned.

BACKGROUND OF THE INVENTION

1. Field of the Invention

This invention relates to drinking cups and more particularly to drinking cups adapted for use in conjunction with hiking and mountain climbing equipment.

2. Description of the Related Art

A piece of equipment which is in frequent use in the activities of mountain climbing and hiking is the drinking cup. While there are many forms of drinking cups, including some which are especially designed for camping use, known drinking cups are generally carried in a backpack as is typically done with other small pieces of equipment. Having a cup packed in a backpack requires the hiker or climber, when he or she wants to use the cup to take a drink, to take off and open the backpack and locate the cup. When the climber is finished with his or her drink, the procedure is repeated in reverse to return the cup to the backpack: and the backpack to the shoulders.

Although packing and unpacking a cup is an inconvenience, the climber or hiker must have both hands free at all times. Thus, the typical practice is to pack: the cup in the backpack rather than hold the cup with a hand. In addition, as a, part of a hiker's equipment, the cup must be sturdy and durable.

A carabiner is a rigid oval or D-shaped ring having an inwardly hingeable latch portion which enables the user to temporarily open the loop. The carabiner is typically made of aluminum and is used for connecting one length of rope to another. A carabiner is commonly used in the activity of hiking and especially for mountain climbing. Other outdoor recreational activities also make beneficial use of a carabiner.

It is also recognized that the carabiner is a piece of distinctive equipment which not only serves its useful purpose of rope attachment, but also is a symbol of the activity of mountain climbing. The carabiner therefore has symbolic value for the recognition of an individual as a climber or hiker. The use of a carabiner or of an object incorporating a carabiner is, therefore, an expression that one is involved in mountain climbing or hiking.

Therefore, it is an object of the invention to provide a drinking cup which may be carried by a mountain climber or hiker without the use of the hands.

It is an additional object of the invention to provide a drinking cup which is easily removable from its carrying place.

It is a further object of the invention to provide a drinking cup which utilizes a carabiner in its design.

Other objects and advantages will be more fully apparent from the following disclosure and appended claims.

SUMMARY OF THE INVENTION

The drinking cup of the invention is a combination of a carabiner and a drinking vessel wherein the carabiner forms a handle for the drinking vessel. The typical carabiner is formed with two long straight sides and two semi-circular ends. One long side is fixed and the other long side has a hinged latch which is biased to remain normally closed. The fixed, long straight side of the carabiner is held firmly against the side of the drinking vessel in a channel, and the latch side of the carabiner is positioned away from the vessel. A pair of flexible bands are wrapped through the loop and around the cup. The bands are secured to hold the carabiner handle to the cup. The carabiner thus attached is useable both as a handle for the cup and as a means to attach the cup to a strap, loop, or other attachment device on the hiker's equipment.

An added advantage of the design configuration of the clip-on cup of the invention is that the carabiner may be used for its originally intended purpose to attach rope lines together when needed. This alternate use may be accomplished with the carabiner on the cup or disconnected from the cup.

In a second embodiment of the invention, the clip-on cup is molded essentially as a single piece, comprising a drinking vessel and a pair of spaced-apart upper and lower handle supports. A separate piece hingeable latch member is then assembled to close the handle. This form of clip-on cup may be attached to a belt or to the exterior of a backpack, but is not intended to be used as a rope-connecting carabiner.

A third embodiment uses an aluminum cylinder as a cup as the carabiner is welded to the exterior side of the cylinder. The welded assembly may then be custom anodized. There is an appreciation and recognition of the value of aluminum welding among serious adventure recreationists. The recognition derives from precision pieces of recreational equipment such as aluminum bike frames, backpacks, boats and climbing equipment. The welding process would make this embodiment of the carabiner unsafe for practical weight-bearing use.

In both embodiments, the carabiner provides a symbol of the user of the cup being associated with mountain climbing.

BRIEF DESCRIPTION OF THE DRAWINGS

FIG. 1 is a side elevation view of the clip-on cup of the invention according to a first embodiment.

FIG. 2 is a top plan view of the cup of FIG. 1.

FIG. 3 is an exploded side elevation view of the clip-on cup of FIG. 1.

DETAILED DESCRIPTION OF THE INVENTION AND PREFERRED EMBODIMENTS THEREOF

Figure 5:
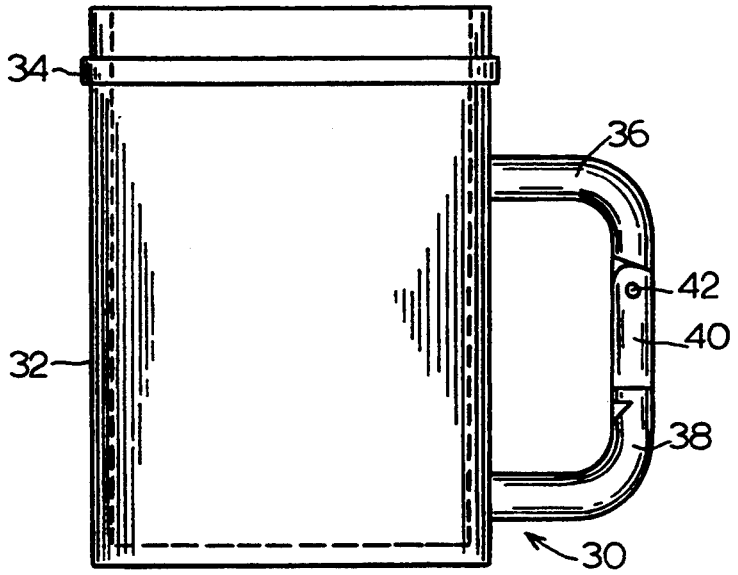
FIG. 5 is a side elevation view of a clip-on cup according to a second embodiment of the invention.

As described briefly above, the present invention provides a novel and useful combination of components to form a new clip-on cup and to provide a symbol of being associated with mountain climbing. According to FIGS. 1, 2 and 3 depicting the first embodiment of the invention, cup 10 of the invention comprises a substantially cylindrical hollow drinking vessel 12, a carabiner 20 and a pair of flexible attachment bands 16. Bands 16 are fitted with complementary segments 18*a*, 18*b* of hook and loop type fastening material which enable the bands to be quickly and securely fastened about drinking vessel 12. Carabiner 20 is of a size adequate to serve as a handle and to enable the user to place at least several fingers through its loop and hold the cup firmly thereby. While a carabiner may be of a variety of shapes, including oval and the popular "D" shape, the drawings illustrate an oval shape for clarity. Latch 22 is pivotable about pin 22*p* to be openable inwardly and is typically biased to remain in the closed position as shown. Latch 22 generally spans the gap between the pair of curved ends of carabiner 20. Latch 22 is illustrated in FIG. 1 in the open position in dashed lines.

Vessel 12 is hollow and formed of a material able to hold a liquid without leaking. Vessel 12 is formed with a pair of parallel circumferential grooves 14 whose outer boundaries are spaced apart a distance Y (FIG. 3) which generally corresponds to the length X of the linear fixed portion 21 of carabiner 20. The width T of each groove 14 is adapted to snugly receive the width U of each band 16. Carabiner 20 is intended to attach to the side of drinking vessel 12 with the major axis A2 (FIG. 1) of carabiner 20 substantially parallel to the axis A1 of vessel 12. Thus, when bands 16 are wrapped around vessel 12 and through carabiner 20, bands 16 act to prevent carabiner 20 from moving upward or downward on vessel 12. Other means of attaching carabiner 20 to vessel 12, such as, for example, mechanical clamps or a single broad band to fit a single broad groove, are feasible within the scope of the invention.

Vessel 12 is further formed with a vertically oriented pair of spaced-apart mirror image support braces 24*a*, 24*b*. Support braces 24*a*, 24*b* define a channel of sufficient radial depth to receive the linear fixed portion 21 of carabiner 20 to more than half its diameter and of axial length greater than the linear portion 21 of carabiner 20, thus preventing carabiner 20 from rotating when held firmly in place by bands 16.

Carabiner 20 is intended to be mounted to drinking vessel 12 with carabiner latch 22 radially away from vessel 12. The orientation of latch 22 may permit the latch to open either at the top or at the bottom, relative to vessel 12.

Figure 4:
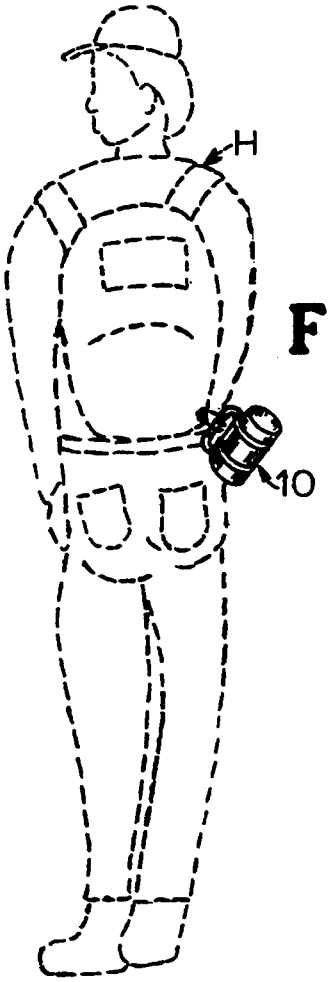
FIG. 4 is a rear elevation view of a hiker/climber with the clip-on cup of the invention suspended from a portion of a backpack.

As configured above, cup 10 may be clipped onto a strap or loop of a backpack worn by hiker H, as shown in FIG. 4. The hinged latch 22 allows for quick removal or attachment of cup 10. In this embodiment, the carabiner 20 may be also used to connect ropes as is its traditional function, either as attached to vessel 12, or removed from vessel 12 to be used independently. When carabiner 20 is removed from the clip-on cup 10, bands 16 may be conveniently wrapped around drinking vessel 12 to prevent loss.

A second embodiment of the present invention is illustrated in FIG. 5. According to the second embodiment of the invention, mug 30 is integrally formed, e.g. by molding processes, with upper handle support 36 and lower handle support 38 protruding radially. Mug 30 is generally formed with a substantially cylindrical hollow container 32 and optionally having a protruding circumfrential rim 34, which is primarily ornamental. A separately formed latch piece 40 is hingedly assembled by means of pin 42 so as to close the gap between upper handle support 36 and lower handle support 38 and further having biasing means, not shown, so as to complete a closure of the mug 30 handle.

In operation, mug 30 of the second embodiment functions similarly to cup. 10 of the first embodiment and is similarly attachable to a strap or loop. The second embodiment is not, however, intended to be used as a strength member in a climbing line attachment, being limited by the material of which it is formed.

Figure 6:
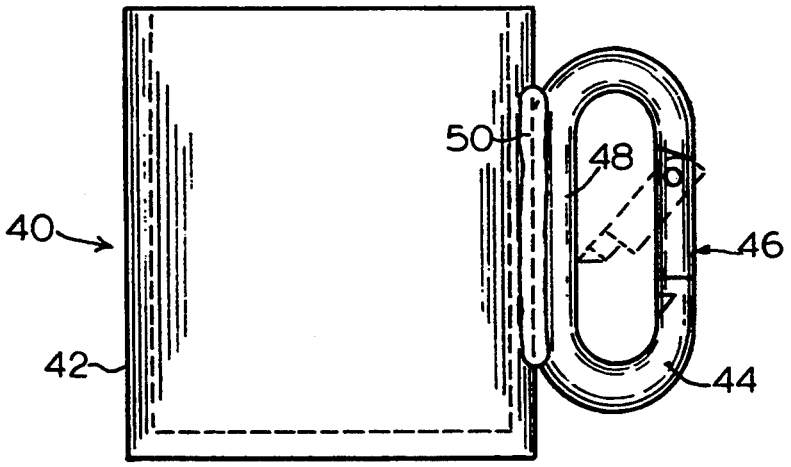
FIG. 6 is a side elevation view of a clip-on cup according to a third embodiment of the invention.

According to a third embodiment, depicted in FIG. 6, clip-on cup 40 comprises drinking vessel 42 and carabiner 44. Carabiner 44 is mounted fixedly at straight leg 48 onto vessel 42 by a pronounced weld 50, serving to engender feelings of strength, while having minimum weight. Latch 46 is positioned and functions as described above. The achievement of strength, or rigidity, with minimum weight is of further interest and attraction to hikers and climbers. Other materials besides aluminum may be utilized in accomplishing the objectives of this embodiment. After assembly by welding, the assembled clip-on cup may be anodized for aesthetic reasons.

To enhance the commercial interest in the clip-on cup of the invention, decoration may be added to the visible portions of the vessel. Further enhancement and variation may be accomplished by the addition of a lid for the drinking vessel. In all embodiments, it will be seen that the carabiner provides both a handle and a symbolic association with mountain climbing both of which characteristics are readily appreciated by the hiker and climber.

While the invention has been described with reference to specific embodiments thereof, it will be appreciated that numerous variations, modifications, and embodiments are possible, and accordingly, all such variations, modifications, and embodiments are to be regarded as being within the spirit and scope of the invention.

What is claimed is:

1. A clip-on drinking vessel comprising:

(a) a hollow cylindrical container having:

(i) a molded body having a substantially planar base and a tubular portion extending therefrom with a central axis and an outer peripheral surface;

(ii) a first annular groove formed in the outer peripheral surface of said tubular portion, and oriented substantially perpendicular to said axis;

(iii) an elongate protrusion integrally molded with said body on and extending radially outwardly from said peripheral surface;

(iv) said protrusion forming a radially outwardly open channel whose axis is parallel to said central axis;

(b) a carabiner having:

(i) a first linear side portion with an upper and a lower end and assembled into said channel;

(ii) a pair of convexly arcuate top and bottom portions each having a first and a second end, said first end of said top arcuate portion being connected to the upper end of said first linear side portion, said first end of said bottom arcuate portion being connected to the lower end of said first linear side portion and said second ends of said top and bottom arcuate portions aligned with each other;

(iii) a second linear side portion extending between and connected to said second ends of each of said top and bottom arcuate portions;

(iv) a latch portion hingedly connected between said second ends and forming a part of said second linear side portion so as to be moveable between a position in which said carabiner is open and a position in which said carabiner is closed, said latch portion being biased toward said closed position; and (v) said first linear side portion, arcuate top and bottom portions, second linear side portion and said latch portion being aligned and forming a rigid structure centered on a common plane extending radially outward from said molded body;

(c) band means mounted within said first annular groove encircling and releasably securing said carabiner first linear side portion in said channel; and (d) said carabiner thereby being releasably attached to said container and retained in a fixed orientation extending radially outwardly from said container with said latch portion positioned outwardly from said container thereby enabling said carabiner to function as a substantially rigid detachable handle for said container while retaining its ability to function as a rope-connecting member.

2. A clip-on drinking vessel as claimed in claim 1 wherein said band means is discontinuous and terminates on each end with interengaging hook-and-loop type fastener material adapted for rapid engagement and disengagement.

3. A clip-on drinking vessel as claimed in claim 1 further comprising a second annular groove formed in said outer peripheral surface substantially parallel to and spaced apart from said first annular groove and additional band means residing in said second groove.

4. A clip-on drinking vessel as claimed in claim 3, wherein said first annular groove is positioned on an upper portion and said second annular groove is positioned on a lower portion of said outer peripheral surface such that the distance between the upper edge of said first annular groove to the lower edge of said second annular groove is substantially equal to the length of said first linear side portion of said carabiner.

* * * * *